US010222122B2

(12) United States Patent
Berner et al.

(10) Patent No.: US 10,222,122 B2
(45) Date of Patent: Mar. 5, 2019

(54) OXIDATION FURNACE

(71) Applicant: EISENMANN SE, Böblingen (DE)

(72) Inventors: Karl Berner, Altdorf (DE); Lars Meinecke, Reutlingen (DE)

(73) Assignee: EISENMANN SE, Böblingen (DE)

( * ) Notice: Subject to any disclaimer, the term of this patent is extended or adjusted under 35 U.S.C. 154(b) by 234 days.

(21) Appl. No.: 15/023,616

(22) PCT Filed: Sep. 17, 2014

(86) PCT No.: PCT/EP2014/002517

§ 371 (c)(1),
(2) Date: Mar. 21, 2016

(87) PCT Pub. No.: WO2015/043728

PCT Pub. Date: Apr. 2, 2015

(65) Prior Publication Data

US 2016/0209115 A1 Jul. 21, 2016

(30) Foreign Application Priority Data

Sep. 24, 2013 (DE) ..... 10 2013 015 841

(51) Int. Cl.
*F27B 9/28* (2006.01)
*D01F 9/32* (2006.01)
*F27B 9/12* (2006.01)

(52) U.S. Cl.
CPC ..... *F27B 9/28* (2013.01); *D01F 9/32* (2013.01); *F27B 9/12* (2013.01); *F27B 2009/124* (2013.01)

(58) Field of Classification Search
CPC ..... F27B 9/12; F27B 9/28
See application file for complete search history.

(56) References Cited

U.S. PATENT DOCUMENTS 4,515,561 A * 5/1985 Melgaard ..... D02J 13/001 126/21 A
4,517,169 A 5/1985 Sumida et al.
4,545,762 A 10/1985 Arita et al.
(Continued)

FOREIGN PATENT DOCUMENTS

CA 2124400 A1 11/1994
DE 102010007480 B3 7/2011
(Continued)

*Primary Examiner* — Nathaniel Herzfeld
(74) *Attorney, Agent, or Firm* — Lucas & Mercanti, LLP; Klaus P. Stoffel

(57) ABSTRACT

An oxidation furnace for the oxidative treatment of fibers, in particular for producing carbon fibers, including a housing, which is gas-tight, apart from passage areas for the fibers, and a process chamber located in the interior of the housing. By an atmosphere device, a hot working atmosphere can be produced and blown into the process chamber. Deflecting rollers, which are arranged outside of the process chamber in deflecting areas, guide the fibers through the process chamber in a serpentine manner so that the fibers lie next to one another as a fiber carpet, wherein the fiber carpet spans a plane between opposite deflecting rollers. Outlet fiber carpets of outlet fibers that have left the process chamber and are on the way to a deflecting roller can be cooled in a specific manner by a fiber-cooling device before the outlet fiber carpets reach the deflecting roller.

14 Claims, 7 Drawing Sheets

(56) References Cited

U.S. PATENT DOCUMENTS

| | | | | |
|---|---|---|---|---|
| 5,263,265 | A * | 11/1993 | Melgaard | B29C 35/06 34/421 |
| 5,994,261 | A | 11/1999 | Tai et al. | |
| 7,004,753 | B2 * | 2/2006 | Stockhausen | D01F 9/32 34/444 |
| 7,335,018 | B2 * | 2/2008 | Yamaguchi | D01F 9/32 432/59 |
| 8,955,235 | B2 | 2/2015 | Berner | |
| 9,139,936 | B2 | 9/2015 | Meinecke et al. | |
| 2012/0304480 | A1 * | 12/2012 | Berner | D01F 9/32 34/203 |
| 2013/0059261 | A1 * | 3/2013 | Sprague | F27B 9/28 432/64 |
| 2013/0171578 | A1 * | 7/2013 | Berner | D01F 9/32 432/199 |
| 2014/0026437 | A1 * | 1/2014 | Meinecke | F27B 9/28 34/634 |
| 2016/0369427 | A1 * | 12/2016 | Mizuno | D01F 9/32 |

FOREIGN PATENT DOCUMENTS

| | | | |
|---|---|---|---|
| DE | 102010007481 | A1 | 8/2011 |
| DE | 102011010298 | B3 | 6/2012 |
| DE | 102010007481 | B4 | 7/2012 |
| EP | 0099629 | A2 | 2/1984 |
| EP | 0110557 | A2 | 6/1984 |
| EP | 0529624 | A2 | 3/1993 |
| EP | 0626548 | A1 | 11/1994 |
| JP | 2008144325 | A | 6/2008 |

* cited by examiner

OXIDATION FURNACE

The present application is a 371 of International application PCT/EP2014/002517, filed Sep. 17, 2014, which claims priority of DE 10 2013 015 841.9, filed Sep. 24, 2013, the priority of these applications is hereby claimed and these applications are incorporated herein by reference.

BACKGROUND OF THE INVENTION

The invention relates to an oxidation furnace for the oxidative treatment of fibres, in particular for the production of carbon fibres, having a) a housing which, apart from passage regions for the fibres, is gas-tight;
b) a process chamber situated in the interior of the housing;
c) an atmosphere device by means of which a hot working atmosphere can be generated and blown into the process chamber;
d) deflecting rollers which are arranged outside the process chamber in deflecting regions and guide the fibres side by side in the form of a fibre carpet through the process chamber in a serpentine manner, wherein the fibre carpet spans a plane between opposing deflecting rollers.

In such oxidation furnaces, the deflecting regions are typically sited outside the furnace housing in order on the one hand to permit intervention on the fibre and on the other hand to prevent inadequate aeration upon deflection at the process temperature. By arranging the deflecting rollers outside the furnace, the fibre is guided at the process temperature out of the process chamber through a lock region in the direction towards the deflecting roller. In the lock region, the fibre is cooled in order to stop the oxidation reaction, the temperature in the lock region being so chosen that gaseous substances from the atmosphere are prevented from condensing out. When the fibre leaves the furnace, the fibre accordingly at least has the temperature prevailing in the lock region. At least some of this heat energy is dissipated to the surrounding atmosphere on the path to the deflecting roller, during deflection and on the path back towards the furnace, or in the case of contact with the deflecting roller to the deflecting roller itself. The fibre accordingly passes through the lock again into the furnace with a significantly lower temperature and must be heated to the process temperature again. The energy loss thus caused by cooling is considerable. It is accordingly constructive to prevent the thread from cooling or deliberately to induce cooling in such a manner that the energy that is released can be fed back to the system again.

During operation of an oxidation furnace, work must be carried out in particular in the deflecting regions and at the deflecting rollers. For example, the fibre carpet may have to be straightened at a deflecting roller if fibres run off track. Individual fibres can also tear as they pass through the oxidation furnace. The loose end of a torn fibre is conventionally linked in the region of the deflecting rollers to an adjacent fibre, which then carries the torn fibre through the oxidation furnace. When carrying out such activities it is consequently beneficial to achieve low temperatures of the fibres in the deflecting region and further to keep the ambient temperature in the region of the deflections low, that is to say only slightly above ambient temperature.

SUMMARY OF THE INVENTION

Accordingly, the object of the invention is to provide an oxidation furnace of the type mentioned at the beginning which takes account of these ideas.

The object is achieved in an oxidation furnace of the type mentioned at the beginning in that e) a fibre cooling device is present, by means of which outgoing fibre carpets of outgoing fibres which have left the process chamber and are on the path to a deflecting roller can purposively be cooled before they reach the deflecting roller.

In this manner it is ensured that the mentioned work in the deflecting region can be carried out at moderate temperatures in the region of the deflecting rollers and at the deflecting rollers themselves, which significantly simplifies continuous operation of the oxidation furnace.

It is advantageous if the outgoing fibres can be exposed by means of the fibre cooling device to a cooling gas which has a lower temperature than the outgoing fibres. There is used as the cooling gas preferably hall air from the equipment hall in which the oxidation furnace is situated.

To that end, the fibre cooling device advantageously comprises an intake system with which a cooling gas can so be taken in that it flows to the outgoing fibre carpets. In the case of hall air, air is consequently taken in from the deflecting regions.

In order to ensure that the cooling gas reaches the outgoing fibres, it is advantageous if the intake system comprises a plurality of intake devices each having a suction side with at least one intake opening, wherein at least one intake device faces each outgoing fibre carpet. Air from the deflecting regions, for example, can thus be taken in through the outgoing fibre carpets to the intake devices and from there can be conveyed away.

In addition, it can be advantageous if the intake system for each outgoing fibre carpet comprises at least one intake device above and at least one intake device below a common outgoing fibre carpet, wherein the suction sides thereof are in each case opposite one another and face the common outgoing fibre carpet. This is advantageous in particular when the outgoing fibres form a closed fibre carpet through which the cooling gas cannot readily flow. However, the cooling gas is thus able to flow along the outgoing fibre carpets.

From a technical point of view, it is advantageous if the intake devices are in the form of intake boxes which are connected by way of one or more intake lines to one or more negative pressure sources.

The fibre cooling device has been found to be particularly efficient in the case of oxidation furnaces in which the deflecting regions are situated outside the furnace housing, the intake devices being arranged in the deflecting regions.

If a conveyor system is present, by means of which cooling gas which has been taken in and heated by the outgoing fibres can be transported away and fed to a further use, the heat energy which has been transmitted from the outgoing fibres to the cooling gas can be used effectively.

For the operation of the oxidation furnace itself, it is particularly energy efficient if cooling gas which has been taken in and heated by the outgoing fibres can be conveyed to the atmosphere device. In this manner, the heated cooling gas can contribute towards the gas balance of the oxidation furnace and in particular towards maintaining the operating temperature.

If the atmosphere device comprises at least one heating unit, it is advantageous if cooling gas which has been taken in and heated by the outgoing fibres can be fed thereto as combustion air.

As an alternative or in addition to the intake system, it is advantageous if the fibre cooling device comprises a blowing system with which outgoing fibres can purposively be blown with cooling gas.

To that end, the blowing system advantageously comprises a plurality of blowing devices each having a blowing side with at least one blowing opening, wherein at least one blowing device faces each outgoing fibre carpet.

Especially in the case of dense outgoing fibre carpets, it is advantageous if the blowing system for each outgoing fibre carpet comprises at least one blowing device above and at least one blowing device below a common outgoing fibre carpet, wherein the blowing sides thereof are in each case opposite one another and face the common outgoing fibre carpet.

The blowing devices are preferably in the form of blowing boxes which are connected by way of one or more blowing lines to a cooling gas source.

The blowing devices can cooperate with the intake devices so that blown cooling air which has been heated by the fibres is conveyed away by the intake system. This will become clear from the explanations given below.

BRIEF DESCRIPTION OF THE DRAWING

Embodiments of the invention will be described in greater detail below with reference to the drawings, in which.

DETAILED DESCRIPTION OF THE INVENTION

Figure 1:
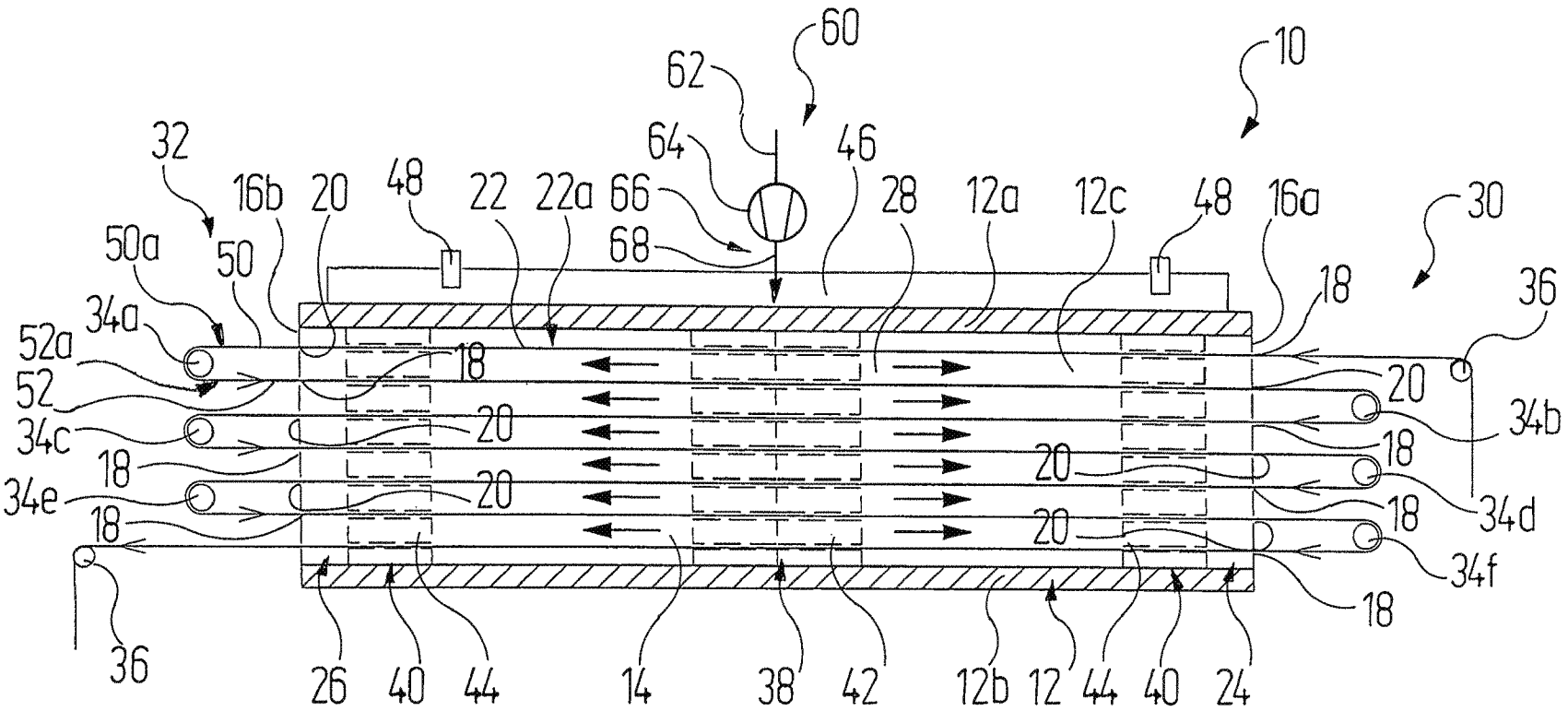
FIG. 1 is a vertical section through an oxidation furnace for the production of carbon fibres in the longitudinal direction of the furnace, in which a process chamber is flanked by open deflecting regions.

Reference will first be made to FIG. 1, which is a vertical section of an oxidation furnace which is used to produce carbon fibres and is designated 10 as a whole.

The oxidation furnace 10 comprises a housing 12 which delimits a passage chamber 14, which forms the interior of the oxidation furnace 10, by means of a top wall 12*a* and a bottom wall 12*b* and two vertical longitudinal walls, of which only a longitudinal wall 12*c* lying behind the section plane can be seen in FIG. 1.

At each of its ends the housing 12 has an end wall 16*a*, 16*b*, wherein horizontal inlet slots 18 and outlet slots 20 alternating from top to bottom are present in the end wall 16*a* and horizontal outlet slots 20 and inlet slots 18 alternating from top to bottom are present in the end wall 16*b*, through which slots the fibres 22 are guided into and out of the passage chamber 14. The inlet and outlet slots 20 generally form passage regions of the housing 12 for the carbon fibres 22. Apart from these passage regions, the housing 12 of the oxidation furnace 10 is gas-tight.

The passage chamber 14 is in turn divided into three regions in the longitudinal direction and comprises a first prechamber 24, which is arranged directly adjacent to the end wall 16*a*, a second prechamber 26, which is directly adjacent to the opposite end wall 16*b*, and a process chamber 28 sited between the prechambers 24, 26.

The prechambers 24 and 26 thus together form an inlet and outlet lock for the fibres 22 into the passage chamber 14 or the process chamber 28.

The fibres 22 to be treated are fed to the passage chamber 14 of the oxidation furnace 10 in parallel as a kind of fibre carpet 22*a*. To that end, the fibres 22 pass from a first deflecting region 30, which is situated adjacent to the end wall 16*a* outside the furnace housing 12, through the topmost inlet slot 18 in the end wall 16*a* into the first prechamber 24. The fibres 22 are then guided through the process chamber 28 and through the second prechamber 26 to a second deflecting region 32, which is situated adjacent to the end wall 16*b* outside the furnace housing 12, and back from there again.

Overall, the fibres 22 pass through the process chamber 28 in a serpentine manner by way of deflecting rollers 34 arranged in succession from top to bottom, which deflecting rollers are designated 34*a*, 34*b*, 34*c*, 34*d*, 34*e*, 34*f* following the path of the fibres from bottom to top. Three deflecting rollers 34*a*, 34*c*, 34*e* lying with their axes parallel one above the other are arranged in the second deflecting region 32 of the oxidation furnace 10, and three such deflecting rollers 34*b*, 34*d*, 34*f* are provided in the first deflecting region 30. Between the deflecting rollers 32*a*, 32*b*, 32*c*, 32*d*, 32*e*, 32*f*, the fibre carpet formed by the plurality of fibres 22 running side by side spans a plane. The path of the fibres can also be from bottom to top. It is also possible for more or fewer planes than shown in FIG. 1 to be spanned.

This is illustrated in FIGS. 2 to 6, in which an enlarged detail section of the second deflecting region 32 is shown, wherein a further deflecting roller 34*g* is in each case present in the second deflecting region 32.

During operation of the oxidation furnace 10, the deflecting regions 30, 32 are continuously in contact with the area surrounding the oxidation furnace 10.

After passing through the entire process chamber 28, the fibres 22 leave the oxidation furnace 10 through the bottommost outlet slot 20 in the end wall 16*b*. Before they reach the topmost inlet slot 18 in the end wall 16*a* and after they leave the oxidation furnace through the bottommost outlet slot 20 in the end wall 16*b*, the fibres 22 are guided over further guide rollers 36 outside the furnace housing 12.

In the process chamber 28, two opposing air streams are maintained. To that end, a blowing-in device 38 is arranged in the middle region of the process chamber 28, and an exhaust device 40 is arranged in each of the two outer end regions of the process chamber 28, adjacent to the prechambers 24, 26. The blowing-in device 38 comprises a plurality of blowing-in boxes 42 and the exhaust devices 40 comprise a plurality of exhaust boxes 44 which are each arranged between the planes spanned by the fibre carpet 22*a* and extend between the vertical longitudinal walls of the furnace housing 12.

Starting, for example, from the exhaust devices 40, the air is conveyed into an air guiding chamber 46 which is situated behind the plane of projection in FIG. 1 and in which it is treated and conditioned in a manner which is of no further interest here, wherein in particular its temperature is adjusted by means of heating units (not shown).

From the air guiding chamber 46, the air passes to the blowing-in device 38. This delivers the circulated and conditioned air into the process chamber 28 in such a manner that it flows in opposite directions towards the deflecting regions 30 and 32. In the process chamber, the air streams flow in opposite directions to the exhaust devices 40, which is illustrated in FIG. 1 by corresponding arrows. Overall, therefore, two circulating air circuits are closed and the oxidation furnace 10 is operated in terms of flow according to the so-called "centre-to-end" principle. However, any other known flow principles can also be implemented.

The blowing-in device 38 and the exhaust devices 40 accordingly form, together with the air guiding chamber 46 and conditioning devices which are present, an atmosphere device with which hot air can be generated as the hot working atmosphere and blown into the process chamber 28.

As the fibres 22 pass in a serpentine manner through the process chamber 28, hot, oxygen-containing air thus flows around them and they are thereby oxidised. The precise configuration both of the blowing-in device 38 and of the exhaust devices 40 and the flow path of the air from the blowing-in device 38 to the exhaust devices 40 are of no further importance in the present document.

Two outlets 48 are additionally provided in the region of the air guiding chamber 46. The gas or air volumes which are either formed in the oxidation process or enter the process chamber 28 as fresh air through an air inlet device (not shown) can be removed via these outlets, in order thus to maintain the air balance in the oxidation furnace 10. The gases which are removed, which may also contain toxic constituents, are fed to thermal post-combustion. The heat which may thereby be recovered can be used at least for preheating the fresh air fed to the oxidation furnace 10.

The fibres 22 which have left the process chamber 28 and are on the path to a deflecting roller 34 are referred to hereinbelow as outgoing fibres 50, which form an outgoing fibre carpet 50*a*. Outgoing fibres 50 are accordingly both fibres 22 which are still in the passage chamber 14 and fibres 22 which have already passed through the outlet slots 20 out of the passage chamber 14 into the deflecting regions 30, 32 and are situated in the deflecting regions 30, 32.

Correspondingly, the fibres 22 which, coming from a deflecting roller 34, are on the path back into the passage chamber 14 and the process chamber 28 again define incoming fibres 52 and form an incoming fibre carpet 52*a*, this being the fibres 22 in the portion of the fibre carpet 22 from the deflecting rollers 34 to the process chamber 28.

In order that maintenance operations discussed at the beginning in the region of the deflecting rollers 34 can be carried out safely, the oxidation furnace 10 comprises a fibre cooling device 54 by means of which the outgoing fibres 50 can purposively be cooled before they reach the deflecting rollers 34. To that end, the outgoing fibres 50 are exposed to a cooling gas which has a lower temperature than the outgoing fibres 50.

FIGS. 2 to 6 each show the second deflecting region 32 of the oxidation furnace 10 with in each case an embodiment of a fibre cooling device 54 on an enlarged scale. An encircled minus sign here symbolises an outflow and an encircled plus sign symbolises an inflow.

Figure 2:
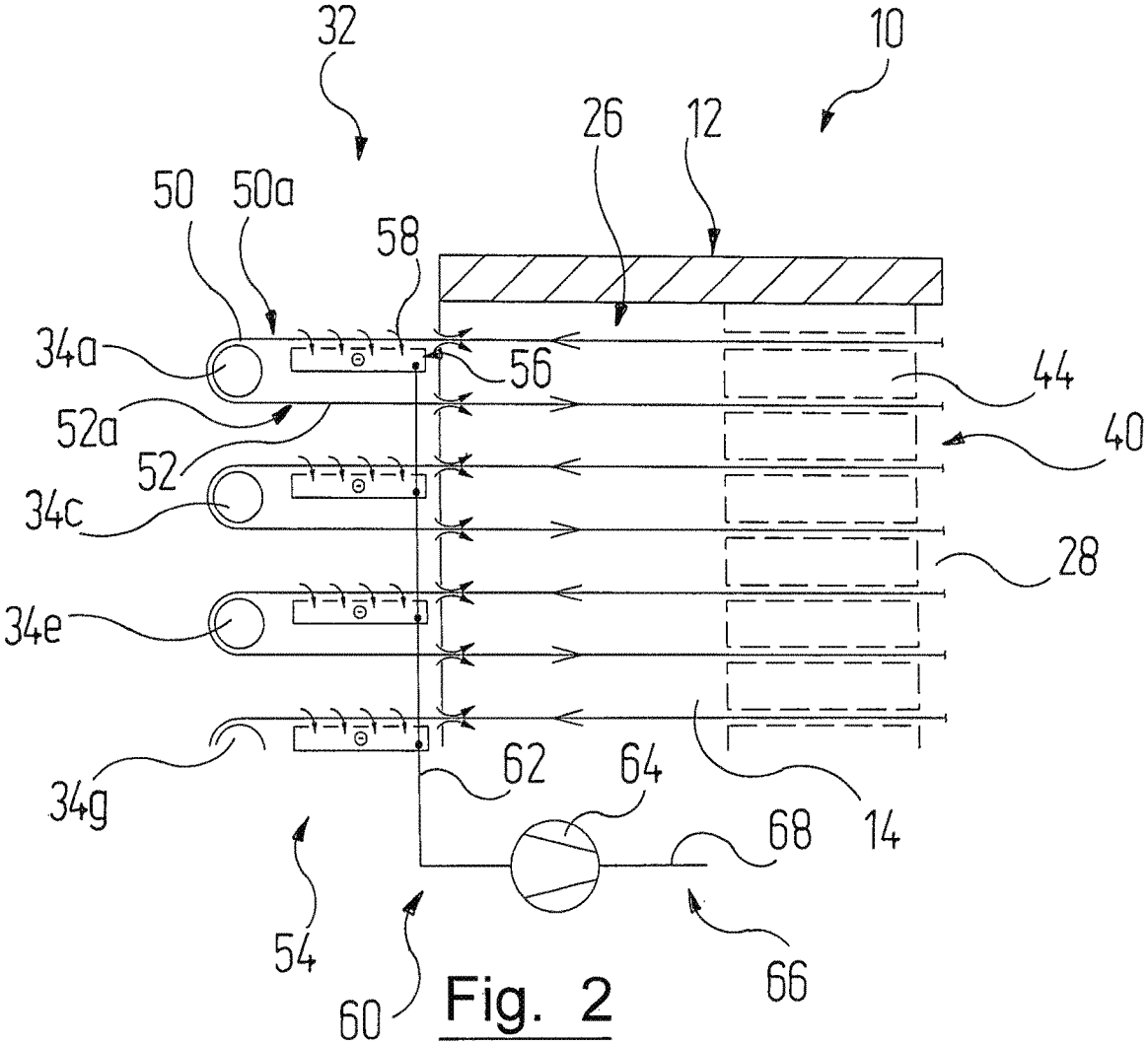
FIG. 2 is a detail section of the oxidation furnace, showing a first embodiment of a fibre cooling device.

The fibre cooling device 54 shown in FIG. 2 comprises a plurality of intake boxes 56 which each extend beneath an outgoing fibre carpet 50*a* at a level with and adjacent to the deflecting roller 34 over which the outgoing fibres 50 run. Only the topmost intake box 56 is provided with a reference numeral.

The intake boxes 56 preferably have a rectangular cross-section and extend parallel to the adjacent deflecting roller 34. On the suction side facing the outgoing fibre carpet 50*a*, the intake boxes 56 have a plurality of intake openings 58, which are distributed over the whole of the suction side. The intake boxes 56 are intake devices of an intake system 60 with which a cooling gas is taken in from the deflecting regions 30 and 32. The cooling gas is generally fresh air, which is available through the hall air of the equipment hall in which the oxidation furnace 10 is situated. That air then flows through the outgoing fibre carpets 50*a*, so that the outgoing fibres 50 are exposed to that air as cooling gas.

To that end, the intake boxes 56 are connected by way of an intake line 62 to a negative pressure source in the form of a fan 64, which operates as an induced draught fan relative to the intake boxes 56. When the oxidation furnace 10 is in operation, the induced draught fan 64 is activated, the air taken in flows through the outgoing fibre carpets 50*a* and thereby takes up heat energy from the outgoing fibres 50, which thereby cool. Before the outgoing fibres 50 reach the deflecting rollers 34, they can thus be cooled considerably relative to their outlet temperature at which they leave the passage chamber 14. For example, the outgoing fibres 50 can be cooled to temperatures of 60° C.

Despite the oxidative reaction being interrupted in the prechambers 24, 26 by the temperature reduction, the outgoing fibres 50 may still emit gases in the deflecting regions 30, 32, whereby HCN inter alia can be released and, without further measures, enters the hall atmosphere. These gas emissions are removed by the intake boxes 56, so that the workplace concentrations are additionally reduced by the gas emissions.

The fibre cooling device 54 is additionally connected to a conveyor system 66 with which the cooling gas, in the present case air, which has been taken in and heated can be transported away and fed to a further use. The heat energy of the heated air can be used in another location, for example, and fed to a heat exchanger for that purpose.

Figure 2A:
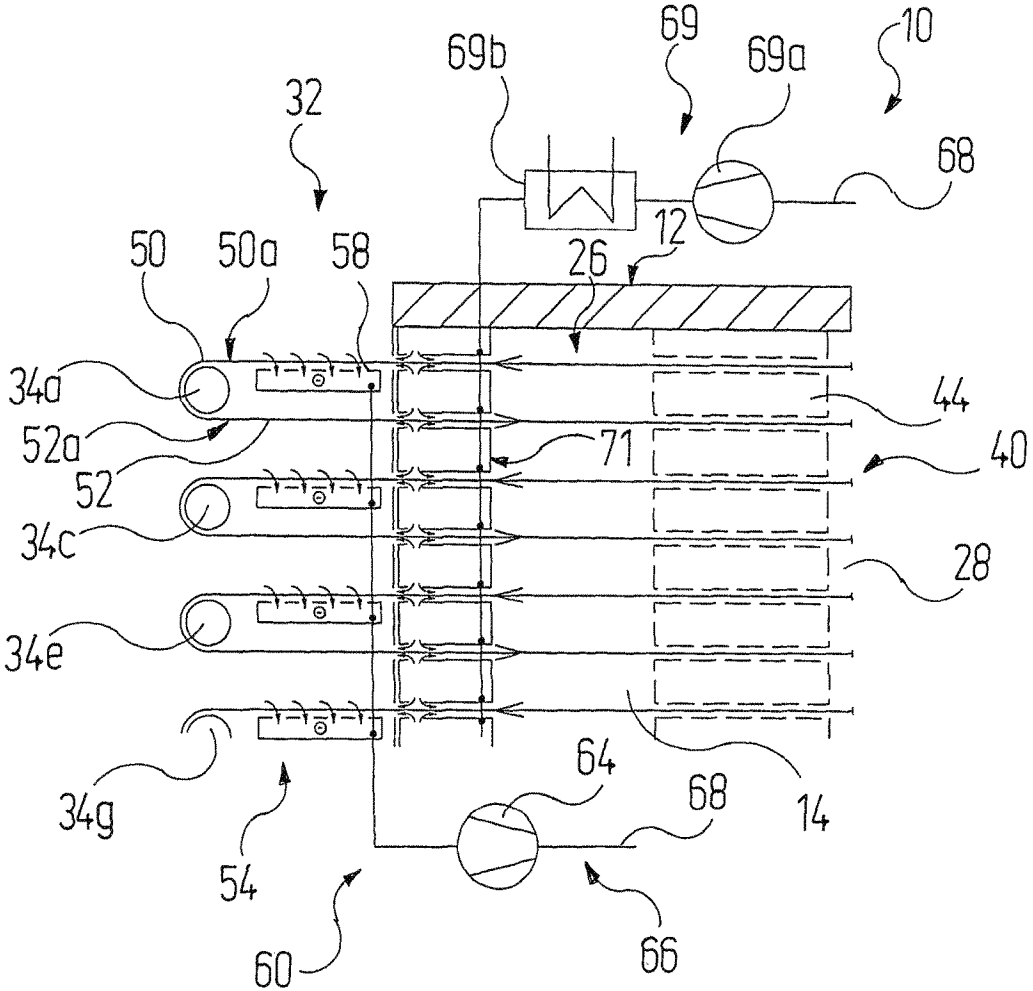
FIG. 2*a* is a detail section of a modified oxidation furnace.

The heated air from the fibre cooling device 54 contributes towards the air balance of the oxidation furnace 10 itself. To that end, the air is fed, for example, via the conveyor system 66 to a fresh air conditioning system 69, which is additionally illustrated in FIG. 2*a*. For this purpose, a line 68 can lead from the induced draught fan 64 to a fresh air fan 69*a* with a downstream heat register or heating unit 69*b*, by means of which the heated air from the fibre cooling device 54 is heated further and flows from there to fresh air channels 71, through which there is supplied in the region of the slots 18, 20 preheated fresh air, which is taken into the recirculating air system of the furnace 10 as a fresh air volume corresponding to the gas or air volumes removed via the outlets 48. In this manner, the heat energy of the outgoing fibres 50 is used to heat the oven atmosphere, so that the energy balance of the oxidation furnace 10 overall is improved.

Figure 3:
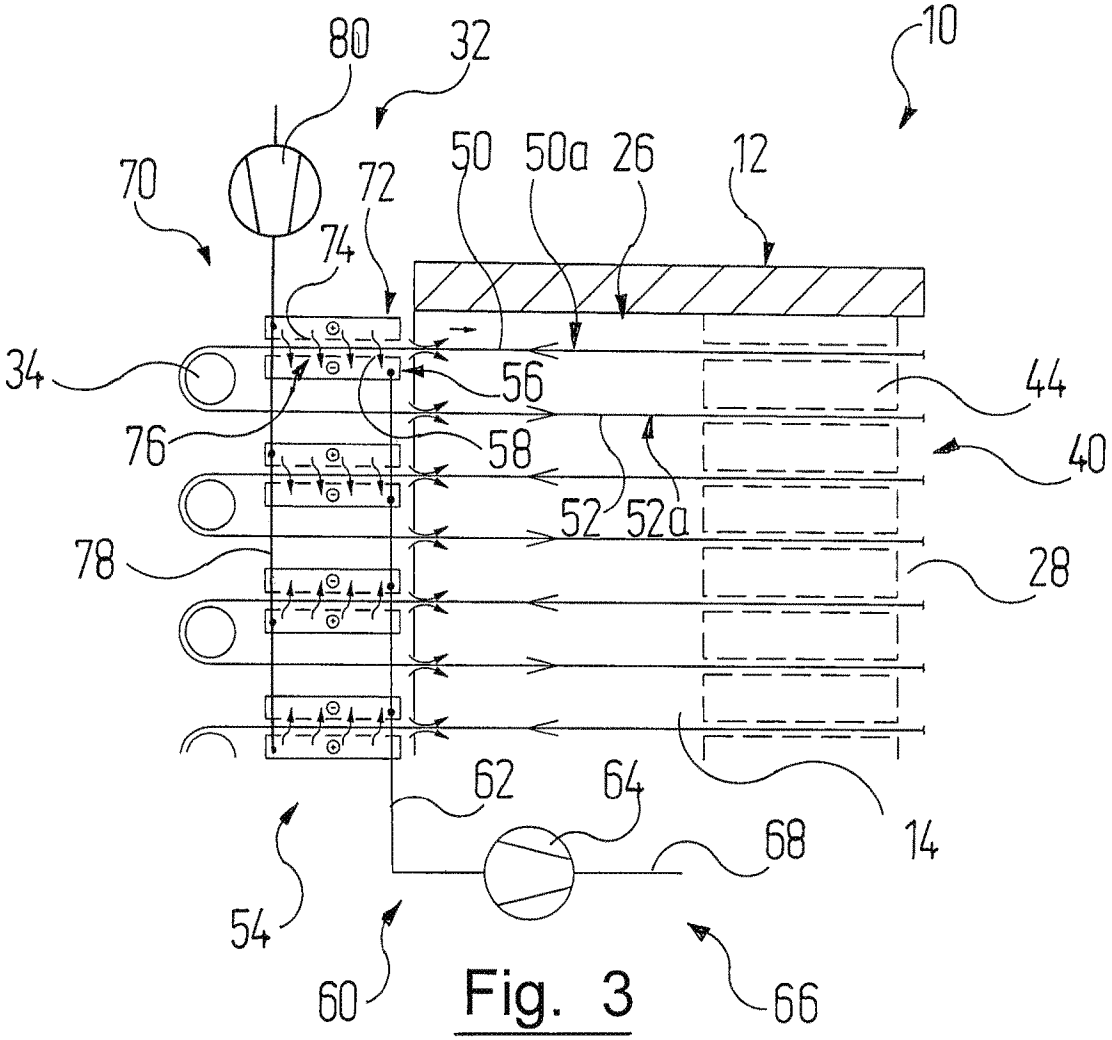
FIG. 3 is a detail section of the oxidation furnace, showing a second embodiment of a fibre cooling device.

FIG. 3 shows as a second embodiment a modified fibre cooling device 54. Components which have already been discussed bear the same reference numerals therein.

In this embodiment, the fibre cooling device 54 additionally comprises a blowing system 70 with which the outgoing fibres 50 can purposively be blown with cooling gas. To that end, a plurality of blowing boxes 72 are present as blowing devices, which blowing boxes correspond in their basic construction to the intake boxes 56 of the intake system 60 and have blowing openings 74 on a blowing side. Only the topmost blowing box 72 is provided with a reference numeral.

In a first variant, the blowing boxes 72 are arranged above the outgoing fibre carpets 50*a* and in each case opposite an intake box 56, the blowing openings 74 of a blowing box 72 facing the intake openings 58 of an intake box 56. This is the case in FIG. 3 with the top two outgoing fibre carpets 50*a*.

In a second variant, the blowing boxes 72 are arranged beneath the outgoing fibre carpets 50*a* and in each case opposite an intake box 56, the intake boxes in this case being situated above the respective outgoing fibre carpet 50*a*. Here too, the blowing openings 74 of a blowing box 72 and the intake openings 58 of an intake box 56 face an outgoing fibre carpet 50*a* running between them and one another. This variant is realised in FIG. 3 in the case of the bottom two outgoing fibre carpets 50*a*.

The flow path 76 between the blowing boxes 72 and the intake boxes 56 is illustrated in FIG. 3 by arrows.

The blowing boxes 72 are supplied with a cooling gas by way of a blowing line 78 by means of a fan 80 serving as the cooling gas source. The cooling gas can be fresh air and, for example, again the hall air. Alternatively, however, cooling gas other than air can also be provided in this manner.

If this cooling gas is not to enter the furnace atmosphere, the conveyor system 66 can also convey the heated cooling gas to another location, where its heat can be used.

Figure 4:
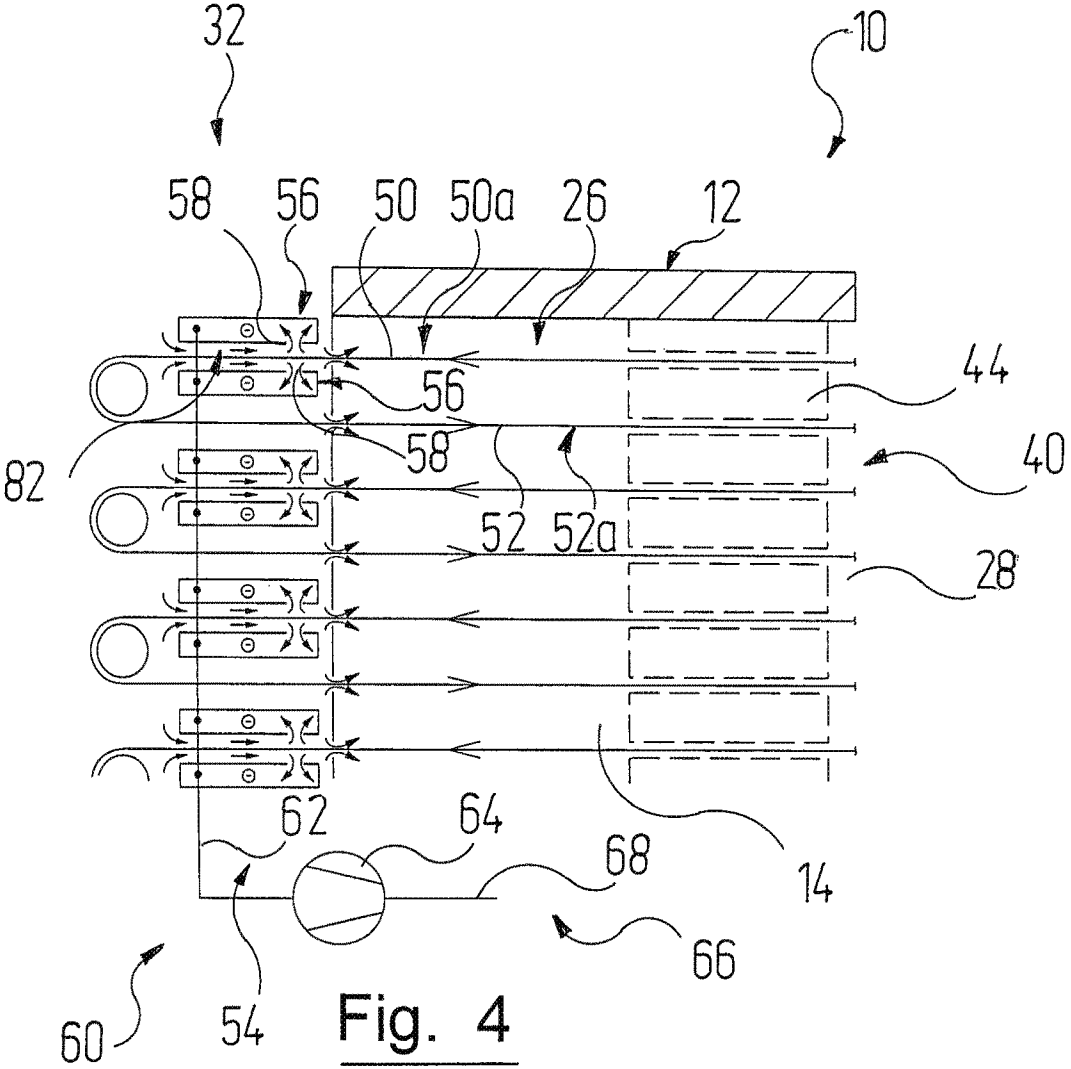
FIG. 4 is a detail section of the oxidation furnace, showing a third embodiment of a fibre cooling device.

FIG. 4 shows as a third embodiment a fibre cooling device 54 which has again been modified. Components which have already been discussed bear the same reference numerals therein.

In this embodiment there is no blowing system 70, but for each outgoing fibre carpet 50*a* an intake box 56 is provided above and an intake box 56 is provided below the outgoing fibre carpet 50*a*, the suction sides thereof in each case being opposite one another and facing the common outgoing fibre carpet 50*a*. The intake openings 58 are not distributed over the whole of the suction side but are present only in the edge regions facing the end walls 16*a*, 16*b* of the oxidation furnace 10.

There is thus formed between the intake boxes 56 a flow channel 82 in which a respective outgoing fibre carpet 50*a* runs. When the induced draught fan 64 is activated, air from outside is drawn as cooling gas through the flow channel 82 between two suction boxes 56, where it is able to flow along above and below the outgoing fibre carpet 50*a* until it reaches the intake openings 58 of the intake boxes 56.

This variant can be used in particular when the fibres 22 form cohesive and closed fibre carpets 22*a* in which a through-flow is difficult. Cooling gas reaches such closed fibre carpets 22*a* on both sides in this manner.

Figure 5:
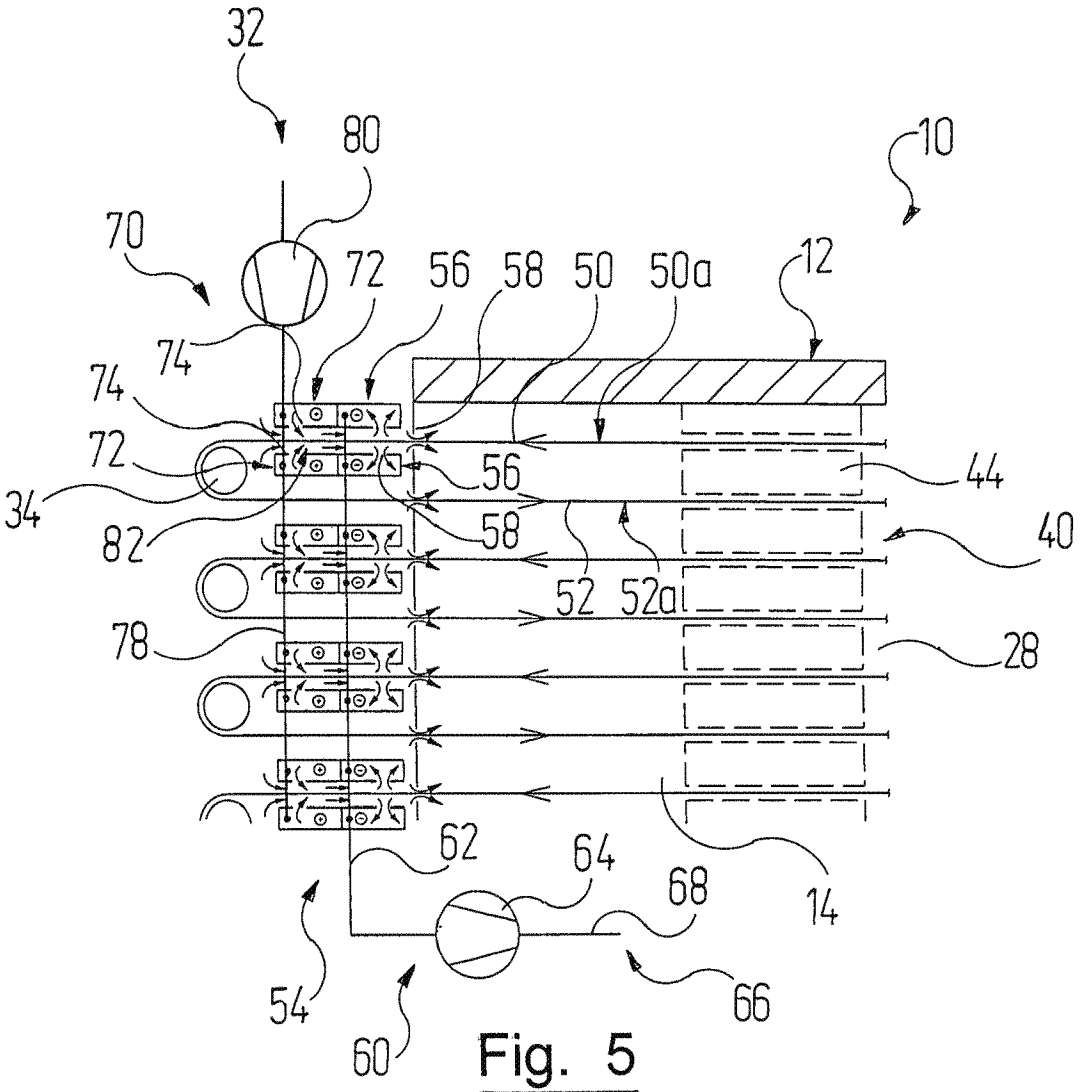
FIG. 5 is a detail section of the oxidation furnace, showing a fourth embodiment of a fibre cooling device.

FIG. 5 shows as a fourth embodiment a fibre cooling device 54 which has again been modified. Components which have already been discussed again bear the same reference numerals.

In this embodiment, both intake boxes 56 and blowing boxes 72 are arranged above and below the outgoing fibre carpets 50*a*. Adjacent to the end wall 16*a* or 16*b* of the oxidation furnace 10 there are intake boxes 56, the suction sides of two intake boxes 56 being opposite one another and facing a common outgoing fibre carpet 50*a*. The intake openings 58 are again present in the edge regions of the intake boxes 56 that face the end walls 16*a*, 16*b* of the oxidation furnace 10.

On the side of the intake boxes 56 that is remote from the end walls 16*a*, 16*b* there are arranged blowing boxes 72, the blowing sides of two blowing boxes 72 correspondingly being opposite one another and facing a common outgoing fibre carpet 50*a*. The blowing openings 74 are arranged in the edge regions of the blowing boxes 72 that are remote from the end walls 16*a*, 16*b* of the oxidation furnace 10 and the intake boxes 56.

A flow channel 82 is again formed in each case between the intake boxes 56 and the blowing boxes 72. The cooling gas from the blowing boxes 72 flows into the flow channel 82 from the top and bottom, relative to the outgoing fibre carpet 50*a*, and along the top and bottom side of the respective outgoing fibre carpet 50*a*, so that the outgoing fibres 50 cool down and the cooling gas is heated and then conveyed away via the intake boxes 56.

At the same time, hall air is drawn into the flow channel 82 on the side of the flow channel 82 that is remote from the end walls 16*a*, 16*b*, which hall air contributes towards cooling the outgoing fibres 50*a*.

Figure 6:
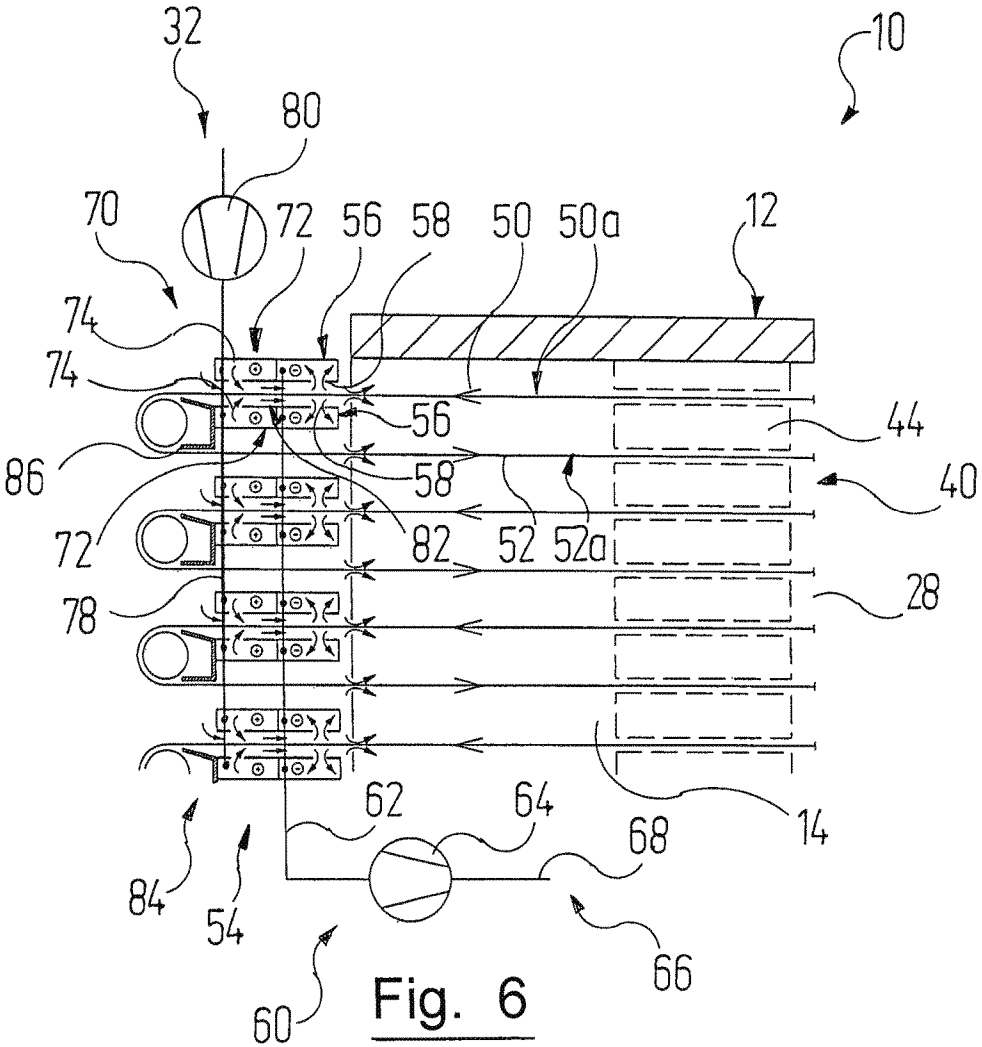
FIG. 6 is a detail section of the oxidation furnace, showing a fifth embodiment of a fibre cooling device.

FIG. 6 shows as a fifth embodiment a supplemented fibre cooling device 54 which corresponds to the fibre cooling device 54 according to FIG. 5 but additionally comprises a protective device 84 for the deflecting rollers 34.

The protective device 84 comprises a plurality of protective plates 86, which in the present embodiment have a C-shaped cross-section, only the topmost protective plate 86 bearing a reference numeral. The protective plates 86 are each situated between an outgoing fibre carpet 50*a* and an incoming fibre carpet 52*a* adjacent to a deflecting roller 34, the open side of the "C" facing the deflecting roller 34. A protective space is thereby formed on the rear side of the deflecting roller 34.

By means of the protective device 84, the risk of the moved and deflected fibres 22 being caught during work on the rear side of the deflecting rollers 34 is reduced. The protective device 84 can also be so designed that the protective plates 86 is designed functionally as part of the intake boxes 56 and blowing boxes 72.

In the embodiments of the fibre cooling device 54 discussed above, there are two principles of operation. On the one hand, the fibre cooling device 54 can be in the form of a passive system in terms of the cooling gas. This means that the cooling gas is available from the surroundings. This is the case in the embodiments in which only an intake system 60 is present.

On the other hand, the fibre cooling device 54 can be in the form of an active system in terms of the cooling gas. This means that the cooling gas is actively supplied from a source. This is the case in the embodiments in which the blowing system 70 is also present.

In modifications (not shown), the fibre cooling device 54 can also operate in the passage chamber 14. For example, the intake boxes 56 can be formed by the exhaust boxes 44 in the passage chamber 14 of the oxidation furnace 10. The outgoing fibre carpets 50*a* are not actively exposed to cooling gas and run either between the closed rear sides of fresh air channels, as are designated 71 in FIG. 2*a* and which then supply only the incoming fibre carpet 52*a* with preheated fresh air, or, in the case of oxidation furnaces 10 without such fresh air channels 71, between air guide plates, whereby a flow channel is thus formed in each case which is accessible through the associated outlet slots 20.

The intake boxes 56 in the form of the exhaust boxes 44 take in the atmosphere from the prechambers 24, 26, so that air from outside is taken in through inlet slots and then flows in the mentioned flow channel along the outgoing fibre carpets 50*a*, cools them and thereby takes up heat energy. From the exhaust boxes 44, that air then passes into the air guiding chamber 46 and back into the process chamber, so that its heat energy contributes to the air balance of the oxidation furnace 10.

The invention claimed is:

1. An oxidation furnace for an oxidative treatment of fibres, comprising:

a) a housing which, apart from passage regions for the fibres, is gas-tight;

b) a process chamber situated in an interior of the housing;

c) an atmosphere device by which a hot working atmosphere is generated and blown into the process chamber;

d) deflecting rollers arranged outside the process chamber and outside the housing in deflecting regions to guide the fibres side by side as a fibre carpet through the process chamber in a serpentine manner, wherein the fibre carpet spans a plane between opposing deflecting rollers; and e) a fibre cooling device arranged outside the housing to cool in a targeted manner, outgoing fibre carpets of outgoing fibres which have left the process chamber and are on a path to a deflecting roller by drawing cooling gas substantially perpendicularly from a first side of the fibre carpets through the fibre carpets into an intake on a second, opposite side of the fibre carpe wherein the fibre cooling device is arranged between the housing and the deflecting roller so that the fibre carpets are cooled before reaching the deflecting roller.

2. The oxidation furnace according to claim 1, wherein the outgoing fibres are exposed by the fibre cooling device to a cooling gas which has a lower temperature than the outgoing fibres.

3. The oxidation furnace according to claim 1, wherein the fibre cooling device comprises an intake system with which a cooling gas is taken in so that the cooling gas flows to the outgoing fibre carpets.

4. The oxidation furnace according to claim 3, wherein the intake system comprises a plurality of intake devices each having a suction side with at least one intake opening, wherein at least one intake device faces each outgoing fibre carpet.

5. The oxidation furnace according to claim 4, wherein the intake system for each outgoing fibre carpet comprises at least one intake device above and at least one intake device below a common outgoing fibre carpet, wherein the suction sides thereof are in each case opposite one another and face the common outgoing fibre carpet.

6. The oxidation furnace according to claim 4, wherein the intake devices are intake boxes which are connected by way of at least one intake line to at least one negative pressure source.

7. The oxidation furnace according to claim 5, wherein the deflecting regions are situated outside the housing and the intake devices are arranged in the deflecting regions.

8. The oxidation furnace according to claim 4, further comprising a conveyor system, by which cooling gas which has been taken in and heated by the outgoing fibres is transported away and fed to a further use.

9. The oxidation furnace according to claim 8, wherein the cooling gas which has been taken in and heated by the outgoing fibres is conveyed to the atmosphere device.

10. The oxidation furnace according to claim 9, wherein the atmosphere device comprises at least one heating unit to which the cooling air which has been taken in and heated by the outgoing fibres is fed as combustion air.

11. The oxidation furnace according to claim 1, wherein the fibre cooling device comprises a blowing system with which outgoing fibres are blown with cooling gas in a targeted manner.

12. The oxidation furnace according to claim 11, wherein the blowing system comprises a plurality of blowing devices each having a blowing side with at least one blowing opening, wherein at least one blowing device faces each outgoing fibre carpet.

13. The oxidation furnace according to claim 12, wherein the blowing system for each outgoing fibre carpet comprises at least one blowing device above and at least one blowing device below a common outgoing fibre carpet, wherein blowing sides of the blowing devices are in each case opposite one another and face the common outgoing fibre carpet.

14. The oxidation furnace according to claim 12, wherein the blowing devices are blowing boxes which are connected by at least one blowing line to a cooling gas source.

* * * * *